United States Patent [19]

Redfield et al.

[11] Patent Number: 4,561,659

[45] Date of Patent: Dec. 31, 1985

[54] DISPLAY LOGIC CIRCUIT FOR MULTIPLE OBJECT PRIORITY

[75] Inventors: James W. Redfield, Pottstown; Albert J. Charpentier, Hatfield, both of Pa.

[73] Assignee: Commodore Business Machines, Inc., West Chester, Pa.

[21] Appl. No.: 456,264

[22] Filed: Jan. 6, 1983 (Under 37 CFR 1.47)

[51] Int. Cl.[4] ..... A63F 9/22

[52] U.S. Cl. ..... 273/313; 273/1 E; 273/DIG. 28; 340/721; 364/410

[58] Field of Search ..... 340/723–726, 340/701, 703, 709, 710, 323 R; 273/1 E, 310, DIG. 28, 312, 313; 364/410, 900 MS File, 200 MS File

[56] References Cited

U.S. PATENT DOCUMENTS 4,031,511 6/1977 Britton ..... 340/146.2
4,170,741 10/1979 Williams ..... 307/355
4,243,984 1/1981 Ackley et al. ..... 340/703
4,286,320 8/1981 Ott ..... 364/200

OTHER PUBLICATIONS

Guttag, K. et al., "Video Display Processor Simulates Three Dimensions", Electronics, Nov, 20, 1980, vol. 53, No. 25.

*Primary Examiner*—Richard C. Pinkham
*Assistant Examiner*—MaryAnn Stoll Lastova
*Attorney, Agent, or Firm*—John J. Simkanich

[57] ABSTRACT

A display control circuit provides the logical determination of display information for each dot point of a color television or other display device used in connection with an electronic game for displaying up to eight "targets", as well as background information, according to a preassigned software defined priority whereby hardware circuitry encodes background-to-target software information and then decodes all game display circuit information to generate a color display code to the color television-type display device, this hardware utilizing a reduced space on a large scale integrated (LSI) circuit.

16 Claims, 4 Drawing Figures

DISPLAY LOGIC CIRCUIT FOR MULTIPLE OBJECT PRIORITY

BACKGROUND OF THE INVENTION

This invention relates to control circuitry incorporated into color television type electronic game devices, for generating input signals to a color television type display. More specifically, it relates to the computer circuit of such an electronic game device where display signals are generated and where such generation of signals must take into consideration selectable priority designations of any of various "targets" with respect to one another and with respect to permanent background information.

These functions have been performed in the past by one configuration or another of computer type circuitry. What is desired, however, is a special circuit, preferably incorporated onto an LSI chip, which is capable of deciding priority of display information between various targets and between these targets and a permanent background display.

An object of this invention is to provide a dedicated circuit for making display decisions between various target and background information.

A second object of this invention is to provide such a circuit which can accept priority designations for each of the various targets and the background information for each location on the display screen, said priority designations being changeable and predeterminable.

Another object of this invention is to provide such a circuit where display signal information is encoded according to said priority designations.

A further object of this invention is to implement the hardware circuitry thereof in solid state LSI format, preferably NMOS utilizing self-booting enhancement silicon devices.

SUMMARY OF THE INVENTION

The objects of this invention are realized in an NMOS, large scale integrated circuit (LSI) chip for providing color video signals to a color television type display, this LSI chip having self-booting enhancement transistors in the circuit.

A priority encoder receives programmable target priority information from serial shift registers as well as background to target priority data information. This information is encoded to provide a background data flag, point-by point display data and an active target identification code to a selection decoder.

The selection decoder also receives color code, video matrix pointer, display window flag, bit map mode indicator, extended and multi-color mode indicator information to provide mutually exclusive color register strobe signals. The color register is connected to provide the output of the invention to the color television type display.

The invention provides, on a dot-by-dot basis, to the color television type display, information corresponding to the object to be displayed from among any of a plurality of targets and any of a plurality of various formations or characteristics comprising the background scene of the display. Thereby certain target will pass in front of certain other targets or in front or behind certain background formations as the targets pass across the color television screen.

DESCRIPTION OF THE DRAWINGS

The features, advantages and operation of the invention will become readily apparent from a reading of the following detailed description in connection with the accompanying drawings in which.

DETAILED DESCRIPTION OF THE INVENTION

A special purpose decoder/interpreter circuit is dedicated for providing video display information to the video circuitry needed for an electronic game which is connectable to a color television set or other display device. This circuit controls the dot-by-dot information when a plurality of objects are to be displayed, some of which at any given time may collide or occupy the same space. When there is a conflict i.e. a collision of objects, priority must be given to one object which forms the resultant display. Dot-by-dot data comparison is conducted as a function of preassigned priority value.

The circuit of the subject invention operates within a video controller sub-system which receives information from the "program" memory to control the display circuitry of the television set or other suitable display medium. The video controller also communicates with a central processing unit normally resident in the system, this central processing unit communicating with user input signals through an input/output device or interpreter.

The term "SPRITE" has become standard in the industry for an object which is to be displayed as part of a video game. For each video game for which a control program of memory instructions are written, and special purpose circuitry is designed to implement the specific game, any number of SPRITES may be involved, the priority for display of a given SPRITE being selectable beforehand. The special purpose hardware then conducts the decision making process for displaying a particular SPRITE in a collision or conflict situation.

The invention involves a priority encoder with dynamic precharged discharge logic with boot-strap drivers. This encoder utilizes software instructions on the data to be displayed which is loaded and stored in shift registers connected to the encoder. The encoder then drives an address decoder which in turn is connected to the video circuitry for driving the television or other suitable display.

Figure 1:
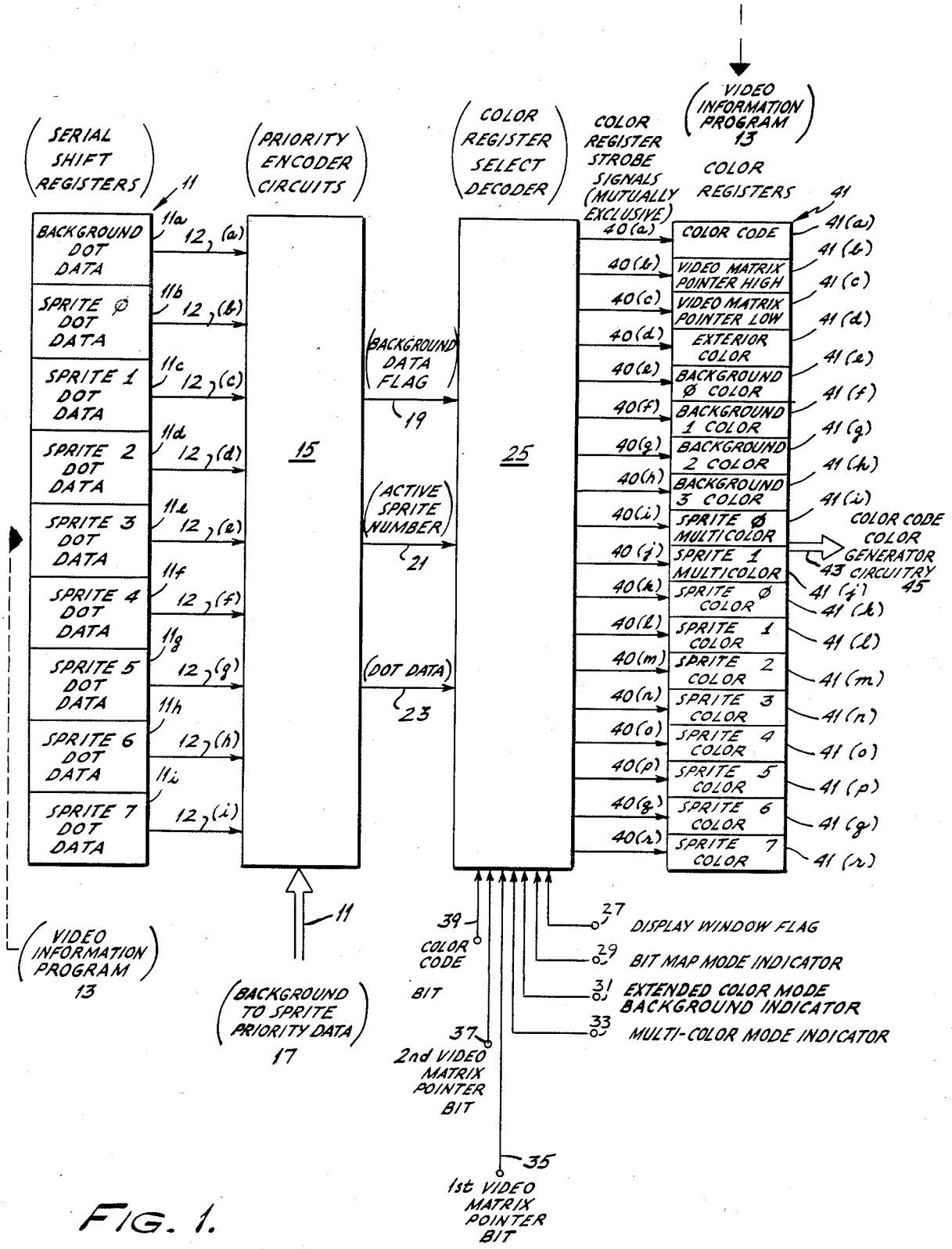
FIG. 1 is a general block diagram of the circuit of the invention showing interconnection of the major circuit components.

FIG. 1 shows a block circuit diagram of the invention with the interconnection of the major circuit components. A plurality of serial shift registers 11 receives information from the video information program 13 which is specific to the video game to be played/displayed. The shift registers 11 contain nine fields of information dedicated to the following separable and specific data:

(11*a*) background dot information,
(11*b*) SPRITE 0 dot information,
(11*c*) SPRITE 1 dot information,
(11*d*) SPRITE 2 dot information,
(11*e*) SPRITE 3 dot information,
(11*f*) SPRITE 4 dot information, (11*g*) SPRITE 5 dot information, (11*h*) SPRITE 6 dot information, and (11*j*) SPRITE 7 dot information.

Each field of information held by the shift registers 11 is transferred to priority encoder circuits 15 via respective, dedicated two-bit parallel transfer lines 12*a* through 12*j*.

The dot information stored in the shift registers 11*a* through 11*j* comprises a four instruction set color code transmitted via the two-bits of information. The encoder circuits 15 also receive an 8-bit instruction word 17 which defines background to SPRITE priority.

Three lines comprise the output six-bit of the encoder circuit 15, these include a first line on which is transmitted a background data flag 19 via one-bit of information. A second output of the encoder circuit 15 is the active SPRITE identification number 21 which is transmitted out of the encoder circuit 15 in parallel fashion as a 3-bit instruction. Dot-by-dot display information 23 is also output over two lines in parallel fashion as a two-bit instruction word.

A color register selection decoder 25 receives the background data flag 19, active SPRITE number 21 and dot information data 23 as well as seven other bits of information.

These seven other bits of information include a display window flag 27, a bit map mode indicator 29, an extended color mode (background) indicator 31, a multiple color mode indicator 33, a first video matrix pointer bit 35, a second video matrix pointer bit 37 and a color code bit 39.

The color register select decoder 25 provides on its output any of a plurality of color register strobe signals 40(*a*) through 40(*r*) on a mutually exclusive basis. Each of these color strobe signal lines 40(*a*) through 40(*r*) is fed to a respective one of a plurality of color registers 41. The color registers provide on a mutually exclusive basis a four-bit obstruction 43 to color code color generator circuitry 45.

The instructions stored in the color registers 41 are loaded from the video information program 13. Of these instructions three involved dynamic register instructions involving standard character and bit map information. These are the color code instruction 41(*a*), the video matrix pointer high instruction 41(*b*) and the video matrix pointer low instruction 41(*c*). Other instructions held in these registers 41 are the "exterior color", instructions 41(*d*), "background color number 0", instruction 41(*e*), "background color number 1", instruction 41(*f*), "background color number 2", instruction 41(*g*), "background color number 3", instruction 41(*h*), "SPRITE number 0 multicolor", instruction 41(*i*), "SPRITE number 1 multicolor", instruction 41(*j*), "SPRITE number 0 color", instruction 41(*k*), "SPRITE number 1 color", instruction 41(*l*), "SPRITE number 2 color", instruction 41(*m*), "SPRITE number 3 color", instruction 41(*n*), "SPRITE number 4 color", instruction 41(*o*), "SPRITE number 5 color", instruction 41(*p*), "SPRITE number 6 color", instruction 41(*q*), and "SPRITE number 7 color", instruction 41(*r*).

This invention deals with nine different sources of display information, on a dot by dot basis. Background data is always displayed at a fixed location on a screen, and eight SPRITE characters, which can be individually displayed at any desired location on the screen are dealt with on a priority basis when the situation occurs that more than one of these sources of information is attempting to display at the same time and place on the screen. The decision is made by the invention as to which information is to be actually displayed. This decision is carried on, repetitively, for each dot location on the screen as the cursor scans the screen. This decision making process must be accomplished with a great deal of speed and should use circuitry which draws relatively little DT power. It is advantageous to precondition the decision making circuitry and to clock its operation using a pair of non-overlapping clock pulses present in the environment in which the circuit invention operates. The encoder circuit 15 focuses its operation on this decision making process.

Assuming that each of the eight SPRITE characters is numbered SPRITE 0 through SPRITE 7, where the highest display priority is assigned to SPRITE 0, the next highest display priority to SPRITE 1 and so forth through SPRITE 7 which has the lowest priority.

If a user desires to interchange the SPRITE to SPRITE priority, he can simply interchange pointers which indicate where the dot data for each of the SPRITE characters is located. The priority decisions are made on a dot by dot basis and SPRITES whose dot data is a logical "0" are not considered for display. This allows for portions of the SPRITES to be transparent, and also allows SPRITES to overlap.

Figure 2:
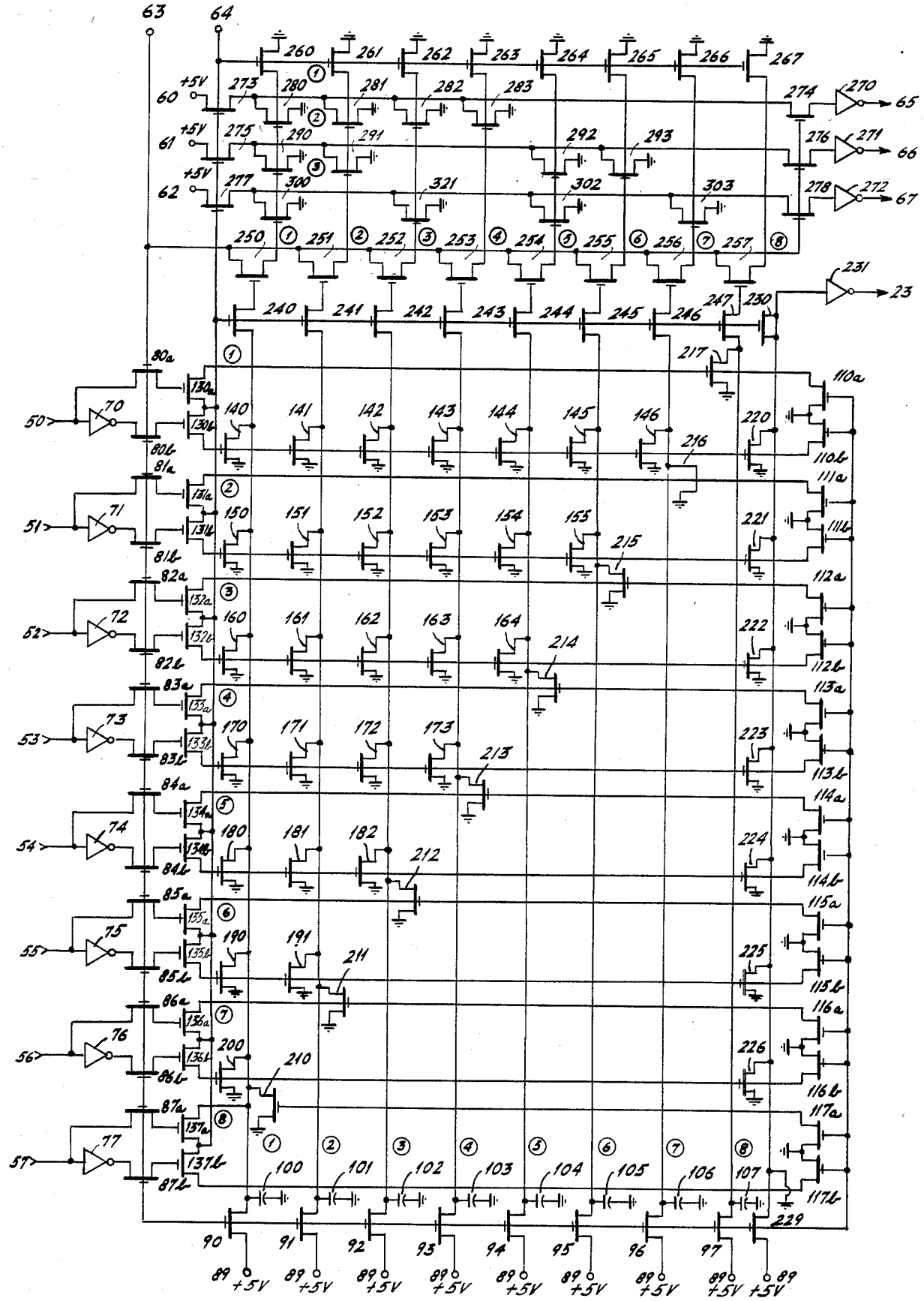
FIG. 2 is a circuit diagram for the priority encoder component of FIG. 1.

The encoder FIG. 15, FIG. 2, is physically structured as an array, or matrix having columns and rows. An active line causes this array to output a three bit value indicating the active SPRITE number to be displayed. If no SPRITE is active, then the background output is activated. This information is then sent on to the decoder 25 of FIG. 1 which controls the strobing of the color registers 41 and therefore the color code information sent to color generator circuitry 45.

By utilizing the clock pulses (Φ1) and (Φ2), bootstrap enhancement or preconditioning of the transistors in the circuit is made possible. An isolation of the input lines of the encoder 15 circuit is also made possible during the "logical" function operation of the circuit 15, reducing DC power consumption.

A programmable 8 bit register is incorporated on the encoder circuit 15 chip. Each bit in the register relates to one SPRITE. When a SPRITE is to have priority over background data, the corresponding background to SPRITE priority register bit is programmed with a logical 1. In this case, whenever the SPRITE and the background have a coincident dot, the background dot is ignored. When the register bit contains a logical 0, and when the background data is a dot, the coincident SPRITE is deactivated.

The shift registers 11 and 41 are commercially available from Texas Instruments, RCA and a number of other sources, as well as is the decoder 25. These circuits 11, 25 and 41 are implemented in these commercial versions on LSI chips.

Priority encoder circuits 15 are implemented in NMOS technology in a large scale integrated circuit (LSI). This encoder 15 can be implemented by a dynamic 8 to 3 encoder design utilizing eight SPRITE priority code input lines 50, 51, 52, 53, 54, 55, 56, 57, corresponding to the information on the lines 12*a* through 12*j* of FIG. 1. A preconditioned logical "high" signal enters a BCD converter portion of the circuit via a +5 volt supply connected to the input lines 60, 61, 62.

The output lines 65, 66, 67 are utilized to pass the background data flag 19, active SPRITE number 21 and dot-data 23 of FIG. 1 as 3-bit binary coded information.

The encoder circuit 15, FIG. 2, is implemented entirely of field effect transistors (FETs) implemented in NMOS hardware. Eight inverters 70, 71, 72, 73, 74, 75, 76, 77 are connected one each, respectively, to the respective input lines 50–57. These inverters provide the inverse of the SPRITE number 0 through 7 dot data information which is input on the lines 50 through 57. A plurality of Fets 80*a*,80*b*, 81*a*,81*b*, 82*a*,82*b*, 83*a*,83*b*, 84*a*,84*b*, 85*a*,85*b*, 86*a*,86*b*, 87*a*,87*b*, are connected drain pin to source pin, one each respectively to a respective one of the input lines 50 through 57 or the output of the inverter amplifiers 70 through 77, with the "a" FET connected to the input and the "b" FET connected to the inverted input.

The circuit architecture is laid out principally in an eight by eight array or matrix, with the eight rows lining up with a respective one of the inputs 50 through 57, and the eight columns connected with a 5 volt power supply 89. The power supply preconditions the output "columns" high so that an output "information" is comprised of a series of "low" bits. Each row connection of the encoder is isolatable from the 5 volt supply 89 by an individual FET 90 through 97 wherein FET 90 is connected, drain-to-source pin, between the 5 volt supply 89 and the respective circuit column. The other FETs 91 through 97 are similarly connected. Each source pin of the power supply switch FETs 90 through 97 has a capacitor connected to ground, these capacitors being designated as capacitor 100 through 107.

A first clock pulse (Φ1) preconditions the circuit and appears on input 63. Input signal 63 is connected to the rows and columns of the circuit by being connected to the gate pin of each of the FETs 80*a* and 80*b* through 87*a* and 87*b*, and 90 through 97. The input signal 63 is used as a function of its state, i.e. "high" or "low", to both isolate and boot-strap condition at the circuit and then to clock the input signal on lines 50 through 57 into the circuit.

A plurality of additional FETs 110(*a*) and (*b*) through 117(*a*) and (*b*) are connected in a paired connection for each row with all of their respective gate pins tied to the input signal 63, and their source pins tied to ground. These FETs 110 through 117 are utilized to shape the falling edge of the output signal by shunting the output pulse to a "low".

Another plurality of FETs are connected in a paired relationship for each of the eight rows associated, one each, with each of the inputs 50 through 57, these paired FETs being designated as FET 130(*a*) and 130(*b*) through FET 137(*a*) and 137(*b*). The gate pins of each of these FETs 130(*a*) and (*b*) through 137(*a*) and (*b*) are connected to the source pin of the respective associated FET. The sequence of interconnection is such that the gate pin of FET 130(*a*) is connected to the source pin of FET 80(*a*), the gate pin of FET 130(*b*) is connected to the source pin of FET 80(*b*), and so on down through the gate pin of FET 137(*b*) being connected to the source pin of FET 87(*b*). The drain pins of these FETs 130(*a*) and (*b*) through 137(*a*) and 137(*b*) are interconnected via their respective drain pins.

Each of the source pins of each of the respective "a" FETs of the plurality 130(*a*) through 137(*a*) is connected to its respective pulse trimming FET of the group 110(*a*) through 117(*b*) on the drain pin of those respective FET's 110(*a*) through 117(*b*).

Seven FETs 140 through 146 are connected with each of their source pins tied to ground, each of their gate pins tied to the source pin of the first column paired FET 130(*b*) and their drain pin connected to a respective one of the first seven columns of the circuit, wherein the drain pin of FET 140 is connected to the source pin of FET 90, the drain pin of FET 141 is connected to the source pin of FET 90, and so on down through the drain pin of FET 146 being connected to the source pin of FET 96.

Five FETs 150 through 155 are utilized to code the second row input from the input 51. These FETs are connected respectively similarly to the connections of the first row FETs 140 through 146, the difference being in the second row the last FET is FET 155. These FETs 150 through 155 have their gate pins tied to the source pin of the FET 131(*b*).

Five FETs 160 through 164 are connected in a similar connection as the FETs in the first and second rows. These latter FETs 160 through 164 are connected for the third row wherein each of their gates is connected to the source pin of the FET 133(*b*).

Four FETs are utilized in the fourth row, these FETs being 170 through 173 and having each of their gate pins connected to the FET 133(*b*).

Three FETs 180 through 182 are connected in the fifth row with their gates tied to the source pin of the FET 134(*b*).

Two FETs 190 and 191 are connected in the sixth row with their gate pins connected to the source pin of the FET 135(*b*).

A single FET 200 is utilized in the seventh row with its gate pin connected to the source pin of the FET 136(*b*).

The FETs 140 through 146, 150 through 155, 160 through 164, 170 through 173, 180 through 182, 190 through 191, and 200 are connected to form a geometric triangular structure with each of the FETs 140, 150, 160, 170, 180, 190, and 200 connected with its drain pin to the source pin of the FET 90.

The FETs 90 through 97 precondition each of the eight columns to a "high" which columns 1 through 7 are changed to a "low" in the presence of the input signal on input line 50; columns 1 through 6 are changed to a "low" in the presence of an input signal on input line 51; columns 1 through 5 are changed to a "low" in the presence of an input signal on input line 52; columns 1 through 4 are changed to a "low" in the presence of an input signal on the input line 53; columns 1 through 3 are changed to a "low" in the presence of an input signal on input line 54; columns 1 and 2 are changed to a "low" in the presence of an input signal on input line 55; or column 1 is changed to a "low" in the presence of input signal on line 56. All columns remain "high" even in the presence of an input signal on line 57. This scheme is utilized to save silicon area instead of dedicating an additional transistor to each of the columns.

Therefore, when an input signal appears on a higher priority order input, (i.e., input 50 over inputs 51 through 57, input 51 over inputs 52 through 57, and so forth right on down through input 56 over input 57) the higher order priority input takes precedence and that SPRITE is displayed.

Each of the priority instruction transistors (i.e. FET 140 through 146, FET 150 through 155, and so on right through FET 200) are connected to the inverse side of each row (i.e. the "b" row FET). A single parity or "checking FET" is connected with its gate pin to a respective one of the non-inverted row FETs i.e. the "a" FETs. These "checking" Fets are connected with Fet 210 connected on its drain pin connected to the first column and its gate pin triggered by the eighth row and its source pin tied to ground. FET 211 is connected similarly between the second column, seventh row and ground. FET 212 is connected similarly between the third column and sixth row and ground. FET 213 is connected similarly between the fourth column, fifth row and ground. FET 214 is connected similarly between the fifth column, fourth row and ground. FET 215 has similar interconnection with the sixth column and third row and ground, while FET 216 is similarly interconnected the seventh column, second row and ground and FET 217 is similarly interconnected between the eighth column, first row and ground. These FETs 210 through 217 besides assuring that there is not a false signal input (i.e., a "low" is really a "low" and not the absence of a signal, a "high" is really a "high") provide additional logic to consider when the lowest priority input on input line 57 is present.

Additional output signal integrity is provided by an additional seven FETs 220 through 226, each being connected with their drain pin connected in common to the source pin of an eighth FET 229 whose gate pin is ganged with the gate pins of the FETs 90 through 97 and whose drain pin is connected to the +5 volt power supply. Each of these FETs 220 through 226 is connected on its gate pin to a respective inverse side of the respective rows 1 through 7, with the gate pin of FET 220 being ganged with the gate pins of FET 140 through 146, the gate pin of FET 221 being ganged with the gate pins of FET 150 through 155 and so on down through the gate pin of FET 226 being connected to the gate pin of FET 200.

The drain pins of each of the FETs 220 through 226 are connected through an additional FET 230 from drain to source pin to an output amplifier 231 to provide an output signal 232. This output signal 232 represents a valid output which appears on the output lines 65, 66 and 67. If none of the FETs 220 through 226 are switched to conduction, which would then shut the drain pin of the FET 230 to ground and therefore pass a "low" on to the input of the amplifier 231 to provide an output signal 232 as a "high", it is considered that an invalid output is sent from the circuit.

A respective one of the additional group of FETs 240 through 247 is connected, drain-pin-to-source-pin on the output of each of the respective columns 1 through 8. In this innerconnection the drain pin of FET 240 is tied to the drain pin of FET 140, and likewise for FETs 241 and 141, 242 and 142, and so forth down to FET 246 and 146. The FET 247 drain pin is connected directly to the source pin of the FET 97.

The second non-overlapping clock pulse (Φ2) is input to the circuit on input node 64 which is connected to the drain pin interconnections of each of the FETs and 130(*a*) and 130(*b*), 131(*a*) and 131(*b*) and so forth right through 137(*a*) and 137(*b*). Input line 64 is also connected to the gate pins of each of the FETs 240 through 247 as well as the FET 230.

The display priority instruction from the encoder appears on the source pin of each of the FETs 240 through 247 and is passed on to the BCD (binary coded decimal) portion of the circuit. This BCD portion transforms this eight bit instruction word to a three bit binary coded decimal output appearing on the output lines 65,66, and 67.

The source pin of each of the FETs 240 through 247 is connected to a gate pin of a respective FET 250 through 257. The source pin of each of these latter FETs 250 through 257 is connected to ground through a respective switch FET 260 through 267, the gate pins of each of these switch FETs 260 through 267 being connected to the (Φ2) input node 64. The drain pin of each of the FETs 250 through 257 is connected to the (Φ1) input node 63.

The BCD portion of the circuit transforms eight columns into four rows. With the first row having its output line 65, the second row having its output line at 66, and the third row having its output line 67.

An amplifier 270 is connected on the output line 65, while an amplifier 271 is connected to the output line 66 and an amplifier 272 is connected on the output line 67.

The +5 volt power supply connected to input line 60 passes through a gate FET 273 to an output gate FET 274 to the input of the amplifier 270. The +5 power supply signal appearing on input line 61 passes through a gate FET 275 and an output switch FET 276 to the input to the amplifier 271. The +5 power supply voltage signal appearing on the input line 62 passes FET 277 and a second switch FET 278 to the input to the amplifier 272.

The first row connected to the source pin of FET 273 has four FETs 280 through 283, each connected with their drain pin to the source pin of the FET 273 and their source pin tied to ground. The gate pin of FET 280 is tied to the source pin of FET 250, the gate pin of FET 281 is tied to the source pin of FET 251, the gate pin of FET 282 is tied to the source pin of FET 252, and the gate pin of FET 283 is connected to the source pin of FET 253.

The second row connected to the source pin of the FET 275 has four FETs connected to ground via a drain-to-source pin interconnection. These FETs 290 through 293 are connected with their respective gate pins as follows: FET 290 to the source pin of FET 250, FET 291 to the source pin of FET 251, FET 292 to the source pin of FET 254, and FET 293 to the source pin of FET 255.

The last row connected to the source pin of FET 277 has four FETs 300 through 303 similarly connected except that the gate pin of FET 300 is connected to the source pin of FET 250, the gate pin of FET 301 is connected to the source pin of FET 252, the gate pin of FET 302 is connected to the source pin of FET 254 and the gate pin of FET 303 is connected to the source pin of FET 256.

The second clock pulse (Φ2) node 64 is connected to the gate pins of each of the FETs 260 through 267, FET 273, 275, and 277, while the first clock pulse (Φ1) on input line 63 is connected to the gate pins of the FETs 274, 276 and 278.

The use of these two clock pulses (Φ1) and (Φ2) likewise bootstraps the BCD portion of the circuit of FIG. 2.

Figure 3A:
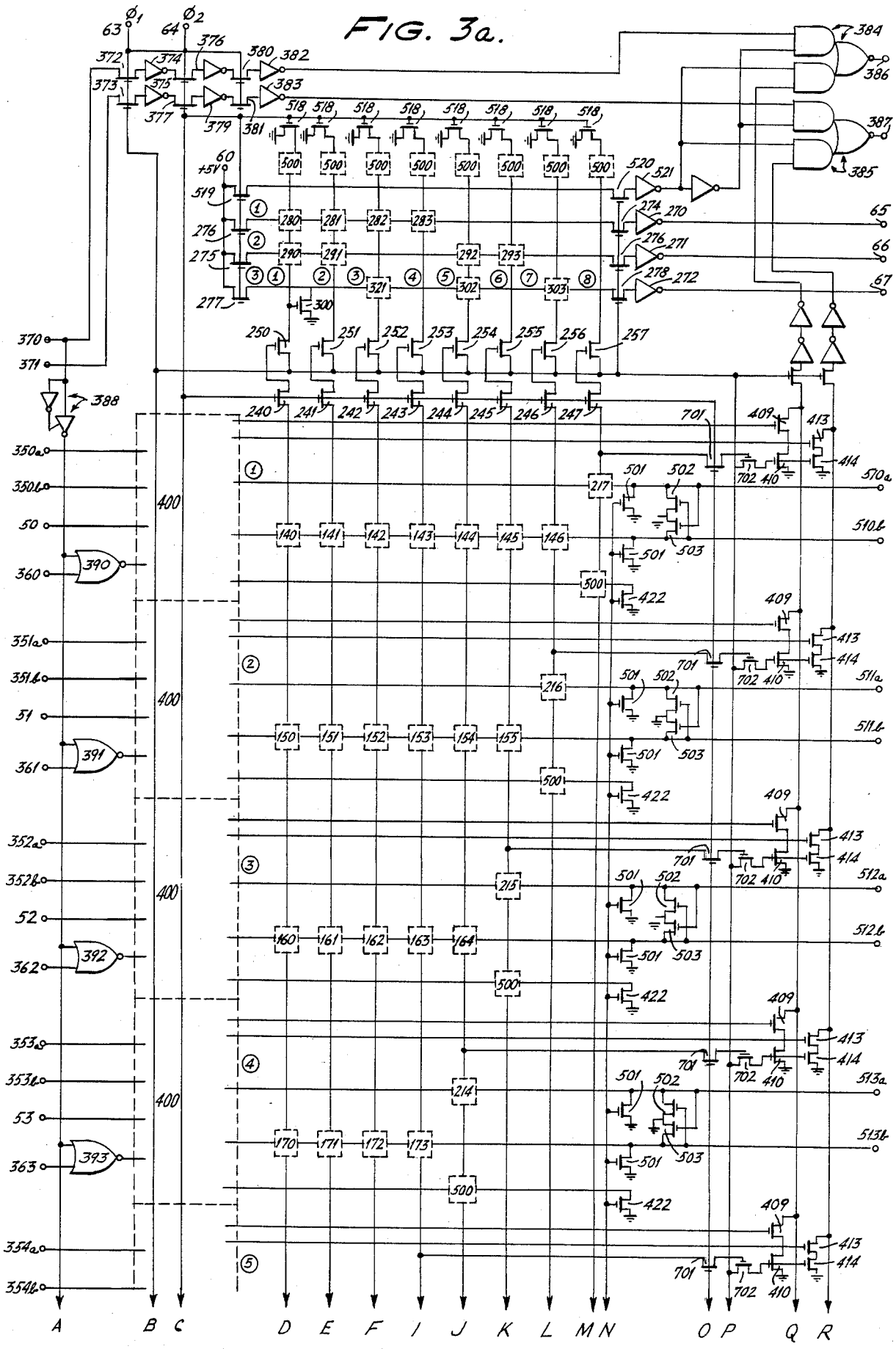
FIGS. 3A and 3B is a circuit diagram of the second embodiment for the priority encoder of FIG. 1.
Figure 3B:
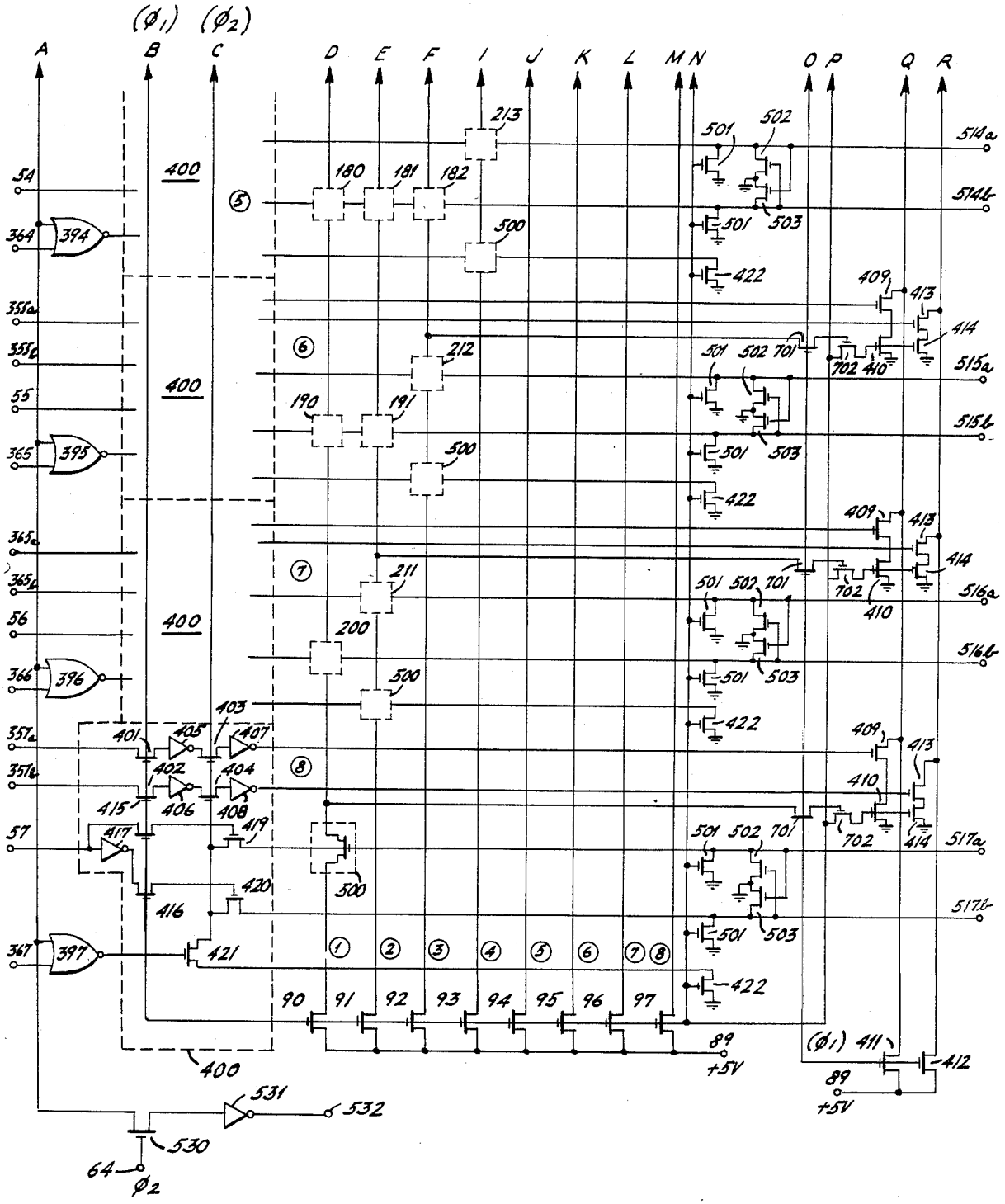

An alternative configuration for the encoder circuit of FIG. 2 is shown in FIGS. 3*a* and *b*. This configuration receives SPRITE dot data inputs on input lines 50, 51, 52, 53, 54, 55, 56, and 57, which represent each of the eight SPRITE numbered 0 through 7 respectively. A two bit background to individual SPRITE priority code is entered with respect to each of the SPRITES on the paired input 350*a* and 350*b* through 357*a* and 357*b*. Individual SPRITE priority for each of the SPRITE 0 through 7 is input on a respective one of the input lines 360, 361, 362, 363, 364, 365, 366, and 367. These inputs regulate SPRITE priority over background information. Background data is input via the two parallel bits which are connected to the input nodes 370 and 371.

The background data bit information appearing on inputs 370 and 371 are each set across respective FETs 372 and 373, these FETs 372 and 373 acting as input switches as they are dated by the first clock pulse (Φ1) appearing on input node 63.

The input switch FETS 372 and 373 each feed a respective amplifier 374 and 375, which amplifier outputs are isolated by the FET switches 376, 377, these latter FETs 376, 377 each being switched on their gate pin by clock pulse (Φ2) appearing on input node 64. The output of FETs 376, 377 each feed a respective amplifier 378 and 379. The output of the amplifiers 378 and 379 are switched through their respective FETs 380 and 381, which FETs 380, 381 are gated to conduction by the first clock pulse (Φ1) on input node 63. A respective amplifier 382, 383 is connected to the respective FET 380, 381.

The output from the amplifier 382 is input to an and-/or invert circuit 384, while the second bit of information which is output of the amplifier 383 is input to a second exclusive circuit 385. The and/or invert circuits 384 and 385 are of a design with four input gates, each having a pair of AND gates connected in tandem to an NOR gate. The background data information received on the input nodes 370 and 371 is therefore output on the nodes 386, 387 respectively as a function of the clocking of the circuit by the first and second clock pulses entered on input nodes 63 and 64 and by the absence of information determined from the rest of the circuit.

The background data bit appearing on the input terminal 370 is connected through a cross coupled amplifier pair 388 to a polarity of NOR gates 390, 391, 392, 393, 394, 395, 396 and 397. One of each of these NOR gates 390 through 397 is dedicated to the respective portion of the circuit for each of the SPRITE priority over background information, whereof input node 360 is connected to NOR gate 390, input node 361 is connected to NOR gate 391, and so forth through input node 367 being connected to NOR gate 397. Each of the group inputs, such as 350(*a*) and (*b*), 50 and 360 are connected to a circuit subsection labeled 400. This is true for the other SPRITES numbered 1 through 7.

The circuitry contained within the circuit subsections 400 is illustrated in connection with the input nodes 357*a*, 357*b*, 57 and 367.

The background to SPRITE priority information appearing on nodes 357*a* and 357*b* are passed through a respective first FET 401, 402 and clocked via the first clock pulse input node 63. A amplifier connects the respective first switched FETs 401,402 to a second switched FET 403, 404. These latter FETs 403,404 being clocked by the second clock pulse appearing on input node 64. The innerconnecting amplifiers are designated as 405 and 406. An amplifier is connected to the output of each of the FETs 403, 404, these amplifiers being designated 407 and 408.

The output of each of the amplifiers 407 and 408 is fed to the gate via series connection of a pair of FETs 409, 410 connected between a +5 volt supply and ground. The first FET 409 picks up the +5 volt supply from input pen 89 through a switch FET 411 which is triggered by the first clock pulse (Φ1) from input node 63. The series connected FET pair 413,414 connected between the +5 volt supply at node 89 and ground is gated via the output of the amplifier 408. This latter series connected FET pair 413, 414 receives its +5 volt signal via the switch FET 412 which are also triggered by the first clock pulse (Φ1) from input node 63. Identical FET pairs are connected for each of the eight rows comprising the structure of the encoder. These series connected FETs 409, 410, 413, 414 are utilized in the circuit to trim the falling edge of the pulses appearing at that point in the circuit.

Input node 57 is connected to a gate or switch FET 415 with an inverse received from an amplifier 417 passed through a respective switch FET 416. The switch FETs 415 and 416 are gate pin operated from the second clock pulse appearing on input node 64. The output from each of the FETs 415 and 416 is fed to a respective FET 419,420 and then onto the row array of the encoder. These FETs 419 and 420 are preconditioned on their drain pins by the first input pulse (Φ1) from node 63. The output from the NOR gate 397 is connected to gate FET 421 which is connected on its drain pin to the input node 64 and has its source pin connected to a row line. A plurality of identical FETs 422 are connected as pull down transistors to ground on each of the source pins of the respective FETs 421. These pull down transistors 422 are all clocked via the first clock pulse (Φ1) appearing on input node 63.

Each of the eight column lines for the array structure is supplied with a preconditioned 5 volt signal via the input terminal 89 through a respective switch FET 90 through 97 similar to the previous emobidment. Each of the switch FETs 90 through 97 is clocked for operation on its gate pin from the input node 63 via the first clock pulse (Φ1).

A bit information passing FET 500 is switched to conduction via a connection on its gate pin. For row eight the source pin of FET 419 is connected to the gate pin of FET 500. This innerconnection of the FET 500 is duplicated for column 2, row 7, column 3, row 6, column 4, row 5, column 5, row 4, column 6, row 3, column 7, row 2, and column 8, row 1.

Each of the FETs 140 through 146, 150 through 155, 160 through 164, 170 through 173, 180 through 182, 190 and 191 and 200 are connected in identical interconnection as with the previous embobiment as are the FETs 211 through 217.

Each of the priority data row lines output from the FETs 419 and 420 have individual pull-down FETs 501 operated identically to the pull-down FETs 422.

The output of FET 500 is passed along each row through a first FET 701 and second FET 702 to gate the FET 410. FET 701 is gated to conduction by the first clock pulse (Φ1) input node 63, while FET is gated by the second (Φ2) input node 64.

Since each of the output of FETs 419 and 420 represents the SPRITE priority data and the mutually exclusive or inverse thereof, cross-coupled paired FETs 502 and 503 are connected between these paired lines and ground for each of the rows 1 through 8 to assure mutual exclusivity.

The output pins 510(*a*) and (*b*) carry the number 0 SPRITE priority data and the inverse thereof, respectively. The output node 511(*a*) and (*b*) through 517(*a*) and (*b*) carry the SPRITE priority data respectively for the SPRITES numbered 1 through 7.

The BCD 8 to 3 array portion of the previous embodiment (FIG. 2) is duplicated in this embodiment both as to the FETs used and their interconnection. This portion of the circuit transfers the data passing through the FETs 240 through 247 and provides the outputs appearing at output nodes 65, 66 and 67. This BCD portion, however, also includes a plurality of pull-down FETs 518 triggered to operate on their gate pin by the signal from the second clock pulse (Φ2) on input node 64 and connected between ground and each of the column lines 1 through 8 of the BCD array.

An additional parity bit is input in the form of a 5 volt signal from input node 60 via switch FET 519 gated on its gate pin by the second clock pulse from input node 64 to pass a "high" through a plurality of the FETs 500 on each of the array column lines 1 through 8 and through an additional switch FET 520 operated on its gate pin from input node 63. The source pin of this FET 520 is connected via an amplifier 521 to the exclusive NOR gate 384 and 385 on one input pin of each of these gates 384 and 385. The output from the amplifier 521 is inverted through the inverting amplifier 522 to be connected to a second input of the exclusive NOR gate 384 and 385. In this way background data bit information is inhibited from being passed to the output nodes 386 and 387 when the logic has determined that, in fact, SPRITE data is to take precedence and be displayed.

The background data bit input on terminal 370 is passed on via the switching FET 530 and amplifier 531 to the output on terminal 532. FET 530 is gated for conduction by the second clock pulse (Φ2) input on terminal 64.

The embodiment of FIGS. 3*a* and *b* provides additional checking circuitry to the embodiment of FIG. 2 wherein background data information is not passed on to the rest of the circuitry if SPRITE display information is to be displayed. Pull-down circuits are liberally used to true up the falling edge of the pulse signals being processed. These circuits are not imperative to the operation of the circuits where a steep falling edge slope is not needed.

The background data bit received on input terminal 370 is past-on via a switch FET 530 connected in series with an amplifier 531 to the output terminal 532. The switch FET 530 is operated to conduct via a gate pin connection to input terminal 64.

The above description of the invention is intended to be illustrative and is not to be read in the limiting sense. Many changes can be made to the structure of the invention without departing from the intent and scope thereof.

What is claimed is:

1. A self-booting reconditioning display decision circuit for connection into a video processor where multiple object and background information is displayed according to assigned priority on a dot-by-dot basis, said video processor being used within a color television electronic circuit having available first and second non-overlapping clock pulses and a storage means including (a) data for producing sprite object and background video information, (b) data for producing background to sprite object priority signals, (c) data for producing color code signals, (d) data for producing first and second video matrix pointer bit signals, (e) data for producing display window flag signals, (f) data for producing bit map mode indicator signals, (g) data for producing extended color mode background indicator signals and (h) data for producing multicolor mode indicator signals, comprising:

register means connected to said storage means for receiving and storing said object and background video information in the form of a plurality of display instructions defining a plurality of said objects and background;

an encoding circuit connected to said storage means to receive said display object and background instructions and said background to object priority signals, and said encoding circuit being connected to said register means;

a decoder circuit, connected to said encoding circuit output, and providing any of a plurality of mutually exclusive output signals designating color register output enable signals, said decoder circuit providing said color register output enable signals under control of said color code signals, said first and second video matrix pointer bit signals, said extended color made background indicator signals, said bit-map mode indicator signals, said multicolor mode indicator signals, and said display window flag signals;

a plurality of color registers connected to said storage means and holding a plurality of color individual display color instructions for object and background display, wherein each color register is enabled by one of said decoder enable signal outputs, each individual display color instruction selected being output from said color register to drive video generator circuitry; and wherein said encoding circuit operates responsive to said first and second clock pulses, whereby said encoding circuit is preconditioned for processing signals loaded thereinto only during said first clock pulse period, and wherein said encoding operation is clocked only during said second clock pulse period.

2. The circuit of claim 1 wherein said encoding means inputs are isolated from receiving input signals during said second clock pulse period.

3. The circuit of claim 2 wherein said encoding means circuitry is isolated from its output to said decoder means during said first clock pulse period whereby said encoding means presents limited power load on said video processor circuitry; and wherein said receiving and storing means comprises a plurality of shift registers connected to said encoding means which receive and hold video information comprising said background data and a priority instruction for each of said display objects.

4. The circuit of claim 3 wherein said encoding means includes a matrix array 8 by 8 (row by column) encoder and a 8 by 3 BCD converter, said 8 by 8 encoder being connected to said plurality shift register outputs and said background to object priority, said 8 by 3 BCD converter being connected to said encoder output on its input and said decoder on its output.

5. The circuit of claim 4 wherein said encoder includes at least one transistor on each of said first seven rows of said encoder array connected to operate to provide an output signal on a column of said encoder array.

6. The circuit of claim 5 wherein said first row contains seven transistors connected, one each, to said first seven columns; wherein said second row contains six transistors connected, one each, to said first six columns; wherein said third row contains five transistors connected, one each, to said first five columns; wherein said fourth row contains four transistors connected, one each, to said first four columns; wherein said fifth row contains three transistors connected, one each, to said first three columns; wherein said sixth row contains two transistors connected, one each, to said first two columns; and wherein said seventh row contains one transistor connected to said first column.

7. The circuit of claim 6 wherein each of said transistors in each of said rows one through seven is preconditioned to a logical "high" by a switched connection to a "high" voltage level.

8. The circuit of claim 7 wherein each of said transistors is switched to a low as a function of a respective object priority input signal on each of said rows.

9. The circuit of claim 8 wherein each said object priority signal is switched into said respective row responsive to said first clock pulse.

10. The circuit of claim 9 wherein each said "high" voltage level to each said row transistor is switched responsive to said first clock pulse.

11. The circuit of claim 10 wherein each switched signal is passed through a transistor implemented switch responsive to said first clock pulse.

12. The circuit of claim 11 also including a third plurality of transistor switches between said first clock pulse responsive row switches and said row transistors, said third plurality of transistor switches being operatively responsive to said second clock pulse.

13. The circuit of claim 12 wherein said BCD converter operation is responsive to said first and second clock pulses.

14. The circuit of claim 13 also including a plurality of pull-down switches connected, one each, to each of said rows, each of said pull-down switches being operatively responsive to said first clock pulse.

15. The circuit of claim 14 wherein said serial shift registers, said encoder, said BCD converter, said decoder and said color registers are implemented in NMOS large scale integration circuitry.

16. The circuit of claim 15 wherein each said switch, each said transistor switch and each said row transistor is implemented as a field effect transistor.

* * * * *

UNITED STATES PATENT AND TRADEMARK OFFICE

CERTIFICATE OF CORRECTION

PATENT NO. : 4,561,659

DATED : Dec. 31, 1985

INVENTOR(S) : James W. Redfield and Albert J. Charpentier

It is certified that error appears in the above-identified patent and that said Letters Patent is hereby corrected as shown below:

Col 3 line 3: Change "(11j)" to - - (11i) - -;

Col 3 line 7: Change "12j" to - - 12i - -;

Col 3 line 9: Change "11j" to - - 11i - -.

Signed and Sealed this

*Twenty-second* Day of *July 1986*

[SEAL]

*Attest:*

DONALD J. QUIGG

*Attesting Officer*

*Commissioner of Patents and Trademarks*